United States Patent [19]

Rieder, deceased et al.

[11] Patent Number: 4,698,941

[45] Date of Patent: Oct. 13, 1987

[54] FRAMEWORK FOR DOME-SHAPED ROOFS

[75] Inventors: Werner Rieder, deceased, late of Rheinfelden; by Margret Rieder, heir, Rheinfelden; Gabriele Uttenweiler, heir, Schworstadt; Barbara Rieder, heir, Rheinfelden, all of Fed. Rep. of Germany

[73] Assignee: Swiss Aluminium Ltd., Chippis, Switzerland

[21] Appl. No.: 871,242

[22] Filed: Jun. 6, 1986

[30] Foreign Application Priority Data

Jun. 10, 1985 [CH] Switzerland ..... 2443/85

[51] Int. Cl.[4] ..... E04B 1/32

[52] U.S. Cl. ..... 52/81; 52/648; 403/176; 403/218

[58] Field of Search ..... 52/80, 81, 648, 82, 52/731; 403/172, 176, 170, 218

[56] References Cited

U.S. PATENT DOCUMENTS

| | | | |
|---|---|---|---|
| 3,857,212 | 12/1974 | Barnett | 52/81 |
| 4,069,638 | 1/1978 | Hasselqvist et al. | 52/731 X |
| 4,194,851 | 3/1980 | Littlefield | 403/218 |

*Primary Examiner*—Carl D. Friedman
*Assistant Examiner*—Naoko N. Slack
*Attorney, Agent, or Firm*—Bachman & LaPointe

[57] ABSTRACT

A frame, in particular for dome shaped roofs, is made up of support sections which run together at junction points where they are joined together; rectangular hollow sections are employed as the support sections and at each junction point two dish-shaped plates at least one of which features a hole providing access by hand to introduce joining means such as threaded bolts, locking ring bolts to attach the ends of the hollow sections to the round plates.

5 Claims, 4 Drawing Figures

FRAMEWORK FOR DOME-SHAPED ROOFS

BACKGROUND OF THE INVENTION

Dome shaped roofs for covering round constructions such as tanks, sewage filter beds, halls and the like are already known in sizes which can be greater than 100 m in diameter. Such supporting constructions or frames are made up of load-bearing elements which form a plurality of irregular triangles, sometimes as required also four-sided units, which are joined at junction points in such a way as to resist bending. These frames support the actual roof covering of sheets which are secured to the frame elements by special clamping strips. As requirements demand such roofs can be fitted with attachments such as positive and negative pressure membrane valves, ventilation flaps and the like, man-holes, props or walkways, platforms for workmen etc.

In the case of a previously known version of such dome shaped roofs I-beam sections are employed as the supporting elements which are joined at their junction points by rivetting or bolting their side flanges to a lower and an upper round plate. This kind of design resulted in a relatively heavy and therefore expensive construction.

The object of the present invention is, while retaining the prescribed strength of the frame, to achieve a reduction in weight and, via the corresponding saving in material, to arrive at a more favourably priced roofing. This object is achieved by means of the design described hereinbelow.

SUMMARY OF THE INVENTION

According to the invention hollow sections are used as the support sections in the frame of a dome shaped roof, said hollow sections being essentially rectangular in cross-section, and for the junction points two each of dish shaped plates at least one of which features at its center a hole allowing access by hand. At the junction points the sections are joined by their bottom and upper walls to the round plates using known means of joining, preferably threaded bolts, locking ring bolts, or rivets and this in such a way as to resist bending.

It has been found advantageous to provide longitudinal stiffening ribs inside the hollow sections serving as supports in this design.

BRIEF DESCRIPTION OF THE DRAWINGS

The present invention is explained in greater detail in the following description of an exemplified embodiment with the help of the schematic figures wherein.

DETAILED DESCRIPTION

Figure 1:
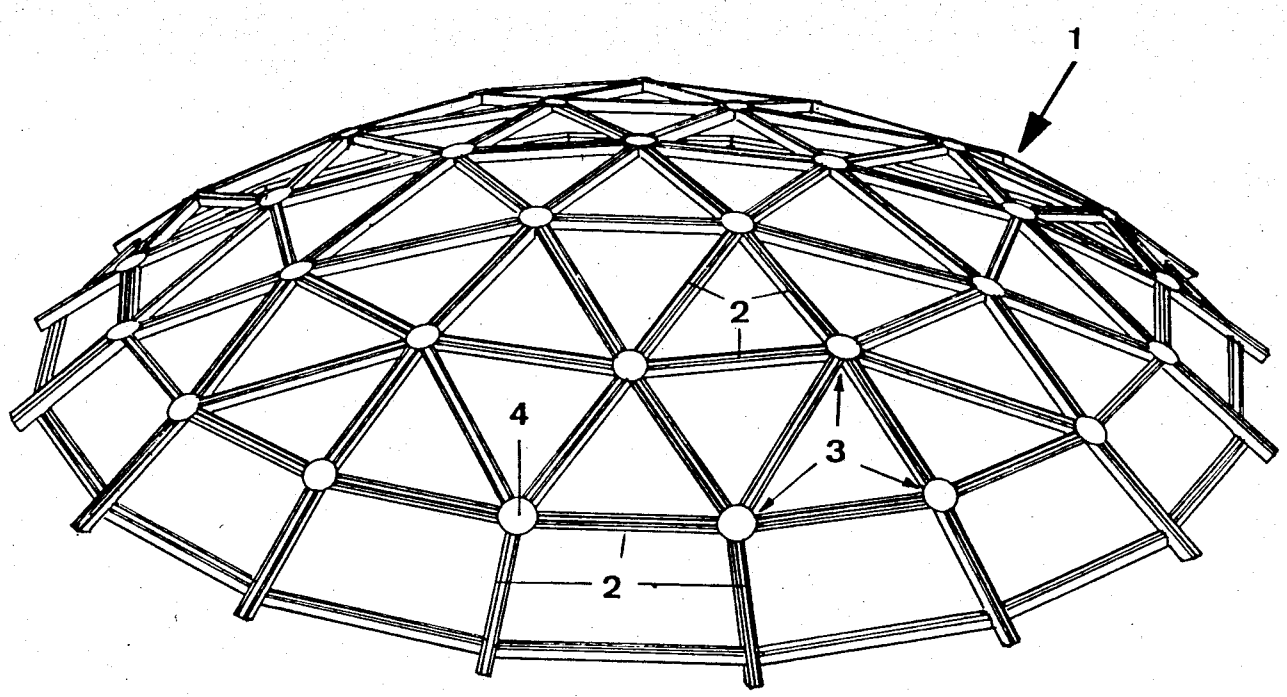
FIG. 1 is a perspective view of the frame of a dome shaped roof.
Figure 2:
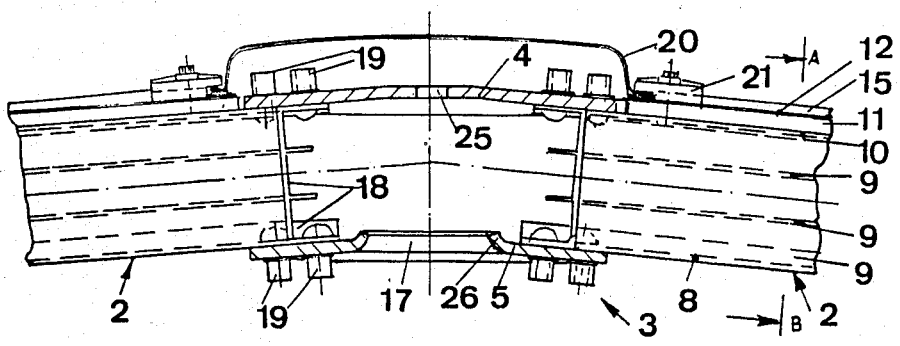
FIG. 2 is a cross-section through a junction point of the frame assembled with roof covering, showing a front elevation of two support sections.

As can be seen from FIG. 1 the dome shaped roof frame 1 is made up of support sections 2 which are joined at their ends to round plates 4 forming junction points 3, the joining being made in such a way as to resist bending. Together the sections 2 make up a plurality of irregular triangles. At the periphery of the roof the sections can also take the form of four sided units. Within the dome at junction points 3 normally six sections 2 meet at a star shape. At the periphery of the roof four or five sections 2 meet.

Figure 4:
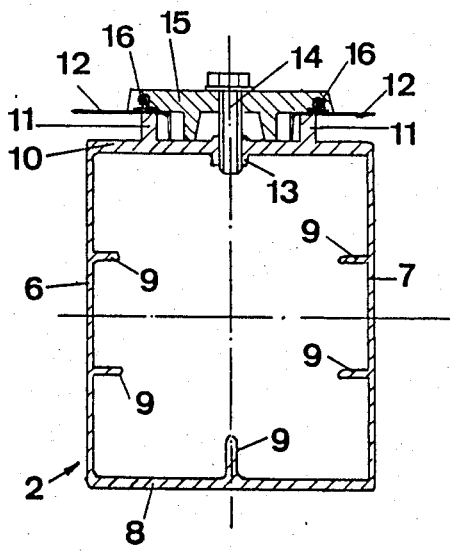
FIG. 4 is a cross-section through a support section along line A–B in FIG. 3.

A favorable cross-section for support sections 2 is shown in FIG. 4 which shows a four sided hollow section, the wall height of which is greater than the wall breadth. Inside, the hollow section 2 features longitudinal stiffening ribs 9 on its sidewalls 6, 7 and on its bottom wall 8. The thickness of the bottom wall 8 is preferably greater than that of the sidewalls 6 and 7. The upper wall 10 of the hollow section is preferably at least as thick as the bottom wall 8. This upper wall 10 features on each side of its middle line a longitudinal rib 11 which points outwards, said ribs 11 together providing a support for the cover sheets 12 and between them a thicker longitudinal part 13 in which threaded holes for threaded bolts 14 can be bored. A cover strip 15 which is attached to the support sections 2 by bolts 14 serves to fix the cover sheets 12 in place. As is normally done, the gaps between the cover strip and cover sheet and sealed, for which purpose the cover sheet 15 can be fitted with sealing sections 16.

The manner in which a junction point 3 can be realized with the described hollow sections 2 can be explained with reference to FIGS. 3 and 4. The joining of the sections coming together at junction point 3 is achieved using an upper round plate 4 and a lower round plate 5, at least one of which, in the illustrated case the lower plate 4, features a hole 17 allowing access by hand.

Figure 3:
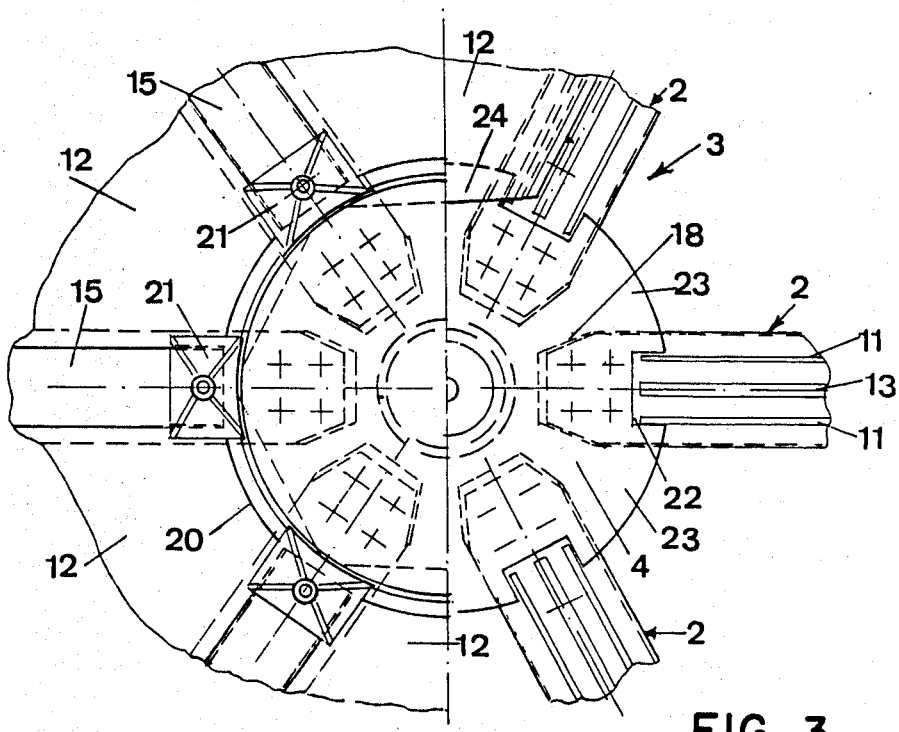
FIG. 3 are plan views of the junction point shown in FIG. 2, showing on the left hand side the complete assembled roof construction and on the right hand side the bare frame.

As shown in FIG. 3 the ends of the sections 2 are tapered slightly in order that they can be introduced sufficiently far towards the center of the plates 4, 5. The resulting sloping faces 18 which also cut across the inner reinforcing ribs 9 are also visible in FIG. 3. Further, the ribs 11 and the thicker part 13 projecting out of the upper wall 10 of sections 2 are cut away in order that this wall 10 can provide a contact surface for the upper plate 4. Threaded bolts for provisional fixing, can be introduced via the opening 17 through the holes provided in the upper wall 10 and bottom wall 8 of section 2 and through the corresponding holes in the upper and lower plates 4 and 5. When the frame or a part thereof has been put together this way, and the supporting sections 2 have adopted their angle of fit with respect to each other, locking ring bolts 19 are inserted in place of the provisional threaded bolts, and then tightened from above or below. In the exemplified embodiment of the invention shown here each section is connected at the junction point 3 to the upper plate 4 by four locking ring bolts 19 and to the lower plate 5 by another 4 such bolts. This enables the components to be joined in a manner that provides resistance to bending. Further, because of the use of the described hollow support sections, the frame achieves a high degree of stability.

After mounting the cover sheets 12 on the assembled frame 1, each region of the junction points 3 is covered by a cap 20 which is held in place by threaded clamping pieces 21 attached to the cover strips 15 or passing through these and attached to the support sections 2.

In the exemplified embodiment shown, the upper plate 4 features at its edge recesses 22 into which the ends of the ribs 11 can be introduced. The projections 23 between these recesses 22 are of such a length that the diameter of the plate at that part is about the same as the diameter of the cap 20. At least at these projections the thickness of the upper plate 4 is as large as the height of the ribs 11 so that the surfaces of the projections 23 and the ribs are in the same plane and so also provide a flat contact surface for the narrow sides 24 of the roofing sheets 12 between the support sections 2. As a result the gap between the cap 20 and the supported edge of sheet 12 can be sealed perfectly and permanently.

Further, the upper plate 4 features a threaded hole in which, of course prior to fixing the cap 20 in place, at selected junction points e.g. hooks can be temporarily mounted for the attachment of a set of hoisting cables to allow the raising and installation of the assembled domed roof on to a building, structure or the like.

The edge 26 of the hole 17 in the lower plate 5 is curved towards the upper plate 3; this is to provide strengthening of the plate 5 and to provide protection for the hand of the fitter.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A frame comprising support sections that come together at junction points in a star shape configuration wherein said support sections have an upper wall and are provided on the upper wall thereof with two upright ribs to support cover sheets for the frame, said support sections are joined together by plates and form a plurality of irregular triangles and if desired four sided units, the improvement comprising hollow sections as the support sections, said hollow sections being essentially rectangular in cross-section and have an upper wall and a bottom wall connected together by a pair of sidewalls, and for the junction points two dish shaped plates wherein at least one of said disc shaped plates features a hole which allows access by hand for joining said hollow sections to said dish shaped plates by joining means.

2. A frame according to claim 1 wherein said hollow support sections are provided on at least one of the sidewalls and bottom wall with longitudinal stiffening ribs.

3. A frame according to claim 1 wherein said support sections are provided on said upper wall between the upright ribs with a thicker part to accommodate threaded holes for threaded bolts.

4. A frame according to claim 3 wherein in the region of the junction points, the ribs and the thicker part are cut away so that the upper wall of the section offers a flat contact surface for the upper plate.

5. A frame according to claim 4 wherein the upper plate is provided with projections which extend between the ends of the ribs, the upper surface of said projections is in the same plane as that of the ribs and, together with the ribs, form a contact surface for the cover sheets.

* * * * *